US011465867B2

(12) United States Patent
Ogasahara

(10) Patent No.: US 11,465,867 B2
(45) Date of Patent: Oct. 11, 2022

(54) IMAGE FORMING APPARATUS CAPABLE OF DETECTING LENGTH OF SHEET IN CONVEYING DIRECTION

(71) Applicant: KYOCERA Document Solutions Inc., Osaka (JP)

(72) Inventor: Okito Ogasahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 285 days.

(21) Appl. No.: 16/932,486

(22) Filed: Jul. 17, 2020

(65) Prior Publication Data

US 2021/0024312 A1 Jan. 28, 2021

(30) Foreign Application Priority Data

Jul. 22, 2019 (JP) ..... JP2019-134722

(51) Int. Cl.

*B65H 7/02* (2006.01)
*B65H 7/14* (2006.01)
*B41J 3/60* (2006.01)

(52) U.S. Cl.

CPC ..... *B65H 7/14* (2013.01); *B41J 3/60* (2013.01); *B65H 2511/11* (2013.01); *B65H 2553/414* (2013.01); *B65H 2553/46* (2013.01); *B65H 2801/03* (2013.01)

(58) Field of Classification Search

CPC ..... B65H 7/14; B65H 7/02; B65H 2511/11; B65H 2553/414; B65H 2553/412; B65H 2553/46; B65H 2701/1313; B65H 2701/1311; B41J 3/60; B41J 11/003; B41J 11/0095

See application file for complete search history.

(56) References Cited

U.S. PATENT DOCUMENTS 6,960,777 B2 * 11/2005 Soar ..... B41J 11/009 250/559.11
7,145,161 B2 * 12/2006 Weast ..... B65H 7/14 250/559.11
2003/0151752 A1 * 8/2003 Langbein ..... B65H 7/14 356/615

(Continued)

FOREIGN PATENT DOCUMENTS

CN 102653188 A 9/2012
CN 108454241 A 8/2018
JP 2006-52032 A 2/2006

*Primary Examiner* — Luis A Gonzalez
(74) *Attorney, Agent, or Firm* — Stein IP, LLC

(57) ABSTRACT

An image forming apparatus includes first and second light emitting units, a light receiving unit for receiving light of the first light emitting unit when it is reflected, and receiving light of the second light emitting unit when it is not reflected, to output a signal of a predetermined level, and a control unit for starting light emission of the first light emitting unit before a front end of a paper sheet reaches an area, stopping light emission of the first light emitting unit while starting light emission of the second light emitting unit before a rear end of the paper sheet passes the area, and detecting a length of the paper sheet based on time after the output signal becomes a predetermined level during light emission of the first light emitting unit until the output signal becomes the predetermined level during light emission of the second light emitting unit.

6 Claims, 9 Drawing Sheets

(56) References Cited

U.S. PATENT DOCUMENTS

| | | | | |
|---|---|---|---|---|
| 2012/0224202 | A1 | 9/2012 | Ito et al. | 358/1.12 |
| 2015/0213348 | A1 | 7/2015 | Ito et al. | |
| 2018/0236789 | A1 | 8/2018 | Yokota | |
| 2020/0238736 | A1* | 7/2020 | Yoshida | B65H 29/52 |
| 2021/0061603 | A1* | 3/2021 | Yamamoto | B65H 7/02 |

* cited by examiner

IMAGE FORMING APPARATUS CAPABLE OF DETECTING LENGTH OF SHEET IN CONVEYING DIRECTION

INCORPORATION BY REFERENCE

This application is based upon and claims the benefit of priority from the corresponding Japanese Patent Application No. 2019-134722 filed Jul. 22, 2019, the entire contents of which are hereby incorporated by reference.

BACKGROUND

The present disclosure relates to an image forming apparatus that forms an image on a paper sheet that is being conveyed.

Conventionally, there is known an image forming apparatus that detects a length in a conveying direction of a paper sheet that is being conveyed.

The conventional image forming apparatus uses a front end sensor and a rear end sensor so as to detect a length in a sheet conveying direction of the paper sheet that is being conveyed. The front end sensor and the rear end sensor are disposed in a conveying path along which the paper sheet is conveyed. The front end sensor is disposed on a downstream side of the rear end sensor in the sheet conveying direction. The rear end sensor is a line sensor including a plurality of light receiving elements arranged in a row. The rear end sensor is disposed in such a manner that the arrangement direction of the light receiving elements is parallel to the sheet conveying direction.

In the conventional image forming apparatus, when the front end sensor detects the front end of the paper sheet, a distance Ap between a reference position and a position of one of the plurality of light receiving elements of the rear end sensor, which detects the rear end of the paper sheet (the end on an upstream side in the sheet conveying direction), is determined. The reference position is a position of a light receiving element on the most downstream side in the sheet conveying direction, among the plurality of light receiving elements of the rear end sensor. Further, the distance Ap is added to an inter-sensor distance Bp to determine a length of the paper sheet. The inter-sensor distance Bp is a distance between the front end sensor and the rear end sensor (the light receiving element on the most downstream side in the sheet conveying direction).

SUMMARY

An image forming apparatus according to one aspect of the present disclosure includes a printer unit, a first light emitting unit, a second light emitting unit, a light receiving unit, and a control unit. The printer unit performs printing on a paper sheet under conveyance along a conveying path. The first light emitting unit emits light toward a detection area in the conveying path on an upstream side in a sheet conveying direction of a printing area for the printer unit to perform printing. The second light emitting unit emits light toward the detection area from a position opposite to a light emitting position of the first light emitting unit with respect to the conveying path. The light receiving unit receives light of the first light emitting unit when the light of the first light emitting unit is reflected by the paper sheet, and receives light of the second light emitting unit when the light of the second light emitting unit is not reflected by the paper sheet but is transmitted, so as to output a signal of a predetermined level when receiving the light of the first light emitting unit or the light of the second light emitting unit. The control unit performs a length detection process, in which light emission of the first light emitting unit starts before a front end of the paper sheet reaches the detection area, the light emission of the first light emitting unit stops while light emission of the second light emitting unit starts before a rear end of the paper sheet opposite to the front end passes the detection area, and a length of the paper sheet in the sheet conveying direction is detected on the basis of time after an output signal of the light receiving unit becomes the predetermined level during light emission of the first light emitting unit, until the output signal of the light receiving unit becomes the predetermined level during light emission of the second light emitting unit.

DETAILED DESCRIPTION

<Structure of Image Forming Apparatus>

Figure 1:
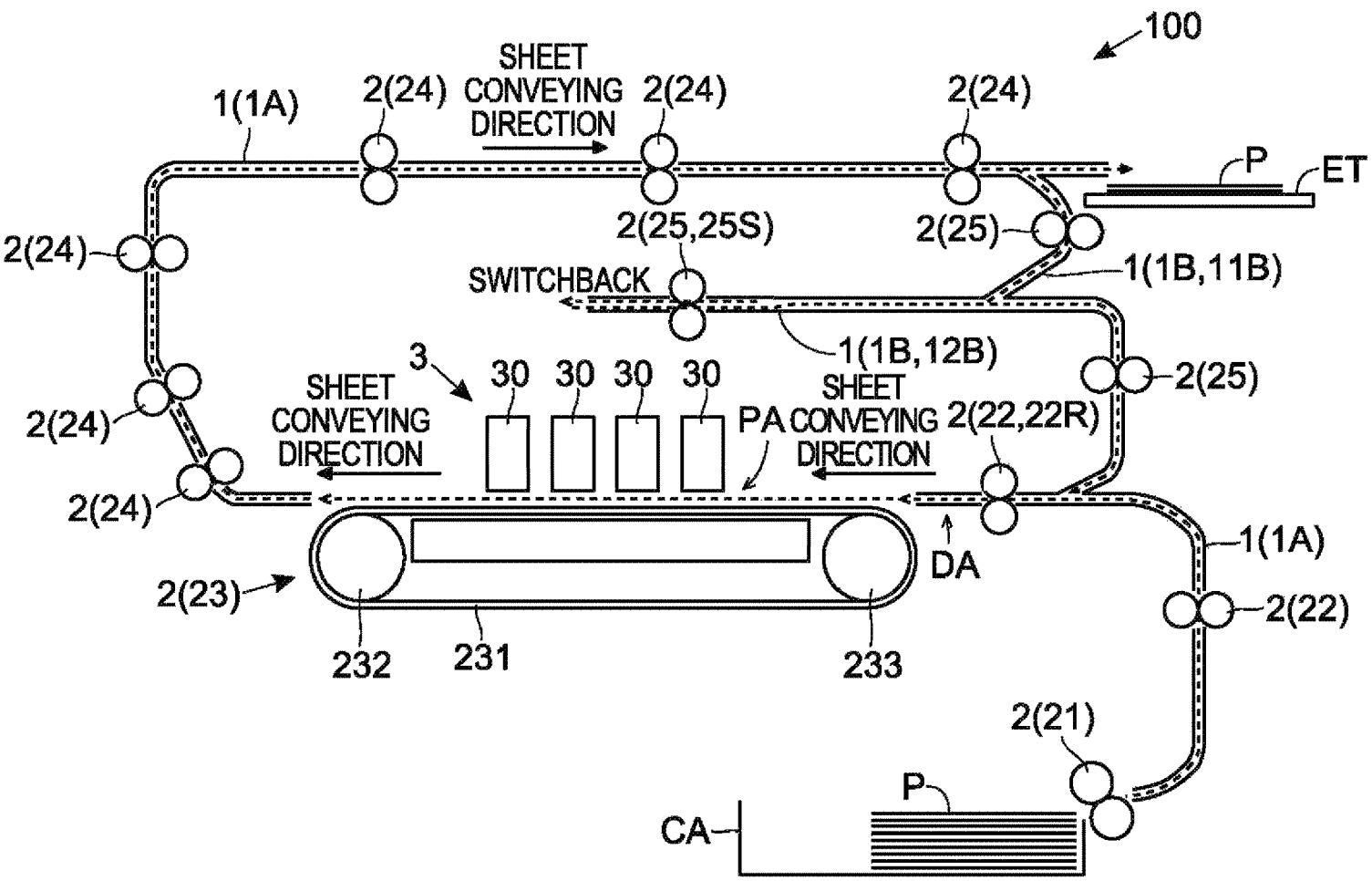
FIG. 1 is a schematic diagram illustrating a structure of an image forming apparatus according to one embodiment of the present disclosure.

As illustrated in FIG. 1, an image forming apparatus 100 of this embodiment includes a conveying path 1 along which a paper sheet P is conveyed. The paper sheets P are stored in a paper sheet cassette CA. The paper sheet P is fed from the paper sheet cassette CA to the conveying path 1, and the fed paper sheet P is conveyed along the conveying path 1. The image forming apparatus 100 performs printing on the paper sheet P that is being conveyed along the conveying path 1.

Figure 2:
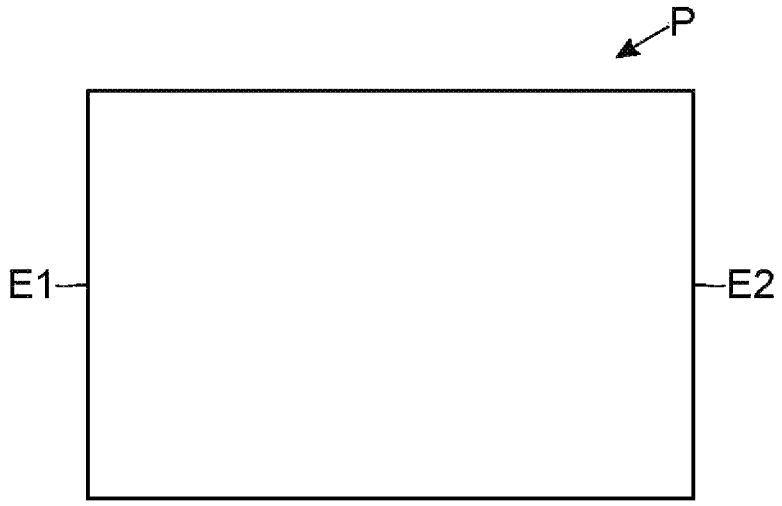
FIG. 2 is a diagram illustrating a paper sheet that is used for printing by the image forming apparatus according to one embodiment of the present disclosure.

In the printing process by the image forming apparatus 100, the paper sheet P as illustrated in FIG. 2 is used (the paper sheet P is conveyed along the conveying path 1). Just after the paper sheet P is fed to the conveying path 1, the paper sheet P is conveyed in such a manner that out of a first end E1 and a second end E2 opposite to the first end E1 of the paper sheet P, the first end E1 is a front end (an end on a downstream side in a sheet conveying direction), and the second end E2 is a rear end (an upstream side end in the sheet conveying direction).

Note that, as described later in detail, in duplex printing, after printing on one side of the paper sheet P, front and rear ends of the paper sheet P under conveyance are reversed (the paper sheet P under conveyance is switched back). When the front and rear ends of the paper sheet P are reversed, the second end E2 of the paper sheet P becomes the front end, and the first end E1 of the paper sheet P becomes the rear end.

With reference to FIG. 1 again, the conveying path 1 includes a main conveying path 1A and a duplex-printing conveying path 1B. The main conveying path 1A extends from the paper sheet cassette CA via a printing area PA to a discharge tray ET. The duplex-printing conveying path 1B branches off at a downstream position of the printing area PA in the sheet conveying direction from the main conveying path 1A, and joins the main conveying path 1A at an upstream position of the printing area PA in the sheet conveying direction. The duplex-printing conveying path 1B is not used in simplex printing to print an image only on one side (surface) of the paper sheet P, but is used in the duplex printing to print on one side of the paper sheet P and then print on the other side (backside) of the paper sheet P.

Further, the image forming apparatus 100 includes a conveyance unit 2 and a printer unit 3. The conveyance unit 2 conveys the paper sheet P along the conveying path 1. The printer unit 3 prints an image on the paper sheet P under conveyance along the conveying path 1.

The conveyance unit 2 includes a sheet feed roller pair 21 and sheet feed side conveyance roller pairs 22. The sheet feed roller pair 21 is disposed at a feed port of the paper sheet P from the paper sheet cassette CA to the conveying path 1. The sheet feed side conveyance roller pairs 22 are disposed between the feed port and the printing area PA in the conveying path 1. The sheet feed side conveyance roller pairs 22 are disposed at a plurality of positions, respectively.

The sheet feed roller pair 21 pulls out the paper sheet P from the paper sheet cassette CA and feeds it to the main conveying path 1A. Further, the sheet feed roller pair 21 conveys the paper sheet P fed to the main conveying path 1A, along the main conveying path 1A. The sheet feed side conveyance roller pairs 22 convey the paper sheet P along the main conveying path 1A together with the sheet feed roller pair 21. In this way, the paper sheet P is conveyed to the printing area PA.

One of the plurality of sheet feed side conveyance roller pairs 22 is a registration roller pair 22R. The registration roller pair 22R is disposed in the main conveying path 1A at a position on the upstream side in the sheet conveying direction of a detection area DA described later, which is a position on the downstream side in the sheet conveying direction of a junction of the main conveying path 1A and the duplex-printing conveying path 1B (a second conveying path 12B described later). The registration roller pair 22R is standstill when the paper sheet P has reached the registration roller pair 22R. In this way, conveyance of the paper sheet P is temporarily stopped. At this time, skew of the paper sheet P is corrected. The registration roller pair 22R conveys the paper sheet P to the printing area PA after temporarily stopping the paper sheet P.

The conveyance unit 2 includes a belt unit 23. The belt unit 23 is disposed in the printing area PA. The belt unit 23 conveys the paper sheet P in the printing area PA. Printing on the paper sheet P by the printer unit 3 is performed on the paper sheet P that is being conveyed by the belt unit 23.

The belt unit 23 includes a conveyor belt 231, a driving roller 232, and a driven roller 233. The conveyor belt 231 has a plurality of suction holes (not shown) penetrating through the conveyor belt 231 in a thickness direction thereof. The conveyor belt 231 is an endless belt. The conveyor belt 231 is stretched around the driving roller 232 and the driven roller 233. The conveyor belt 231 turns when the driving roller 232 rotates.

The paper sheet P that is conveyed to the printing area PA arrives on the conveyor belt 231. At this time, the conveyor belt 231 is turning. In this way, the paper sheet P on the conveyor belt 231 is conveyed. Note that the paper sheet P on the conveyor belt 231 is sucked to intimately contact the conveyor belt 231.

The conveyance unit 2 includes a discharge side conveyance roller pairs 24. The discharge side conveyance roller pairs 24 are disposed on the downstream side of the printing area PA in the sheet conveying direction. The discharge side conveyance roller pairs 24 are disposed at a plurality of positions, respectively.

The discharge side conveyance roller pairs 24 convey the paper sheet P from the printing area PA (the paper sheet P with a printed image) to the discharge tray ET. The paper sheet P after printing is discharged onto the discharge tray ET.

The conveyance unit 2 includes duplex printing conveyance roller pairs 25. The duplex printing conveyance roller pairs 25 are disposed at a plurality of positions, respectively. One of the plurality of duplex printing conveyance roller pairs 25 is a switchback roller pair 25S. The plurality of duplex printing conveyance roller pairs 25 are disposed in the duplex-printing conveying path 1B. The plurality of duplex printing conveyance roller pairs 25 are conveyance roller pairs that are used in the duplex printing. The plurality of duplex printing conveyance roller pairs 25 conveys the paper sheet P along the duplex-printing conveying path 1B.

The duplex-printing conveying path 1B includes a first conveying path 11B and a second conveying path 12B. The first conveying path 11B is a conveying path for pulling the paper sheet P, which is being conveyed toward the discharge tray ET, into the second conveying path 12B. The second conveying path 12B is a conveying path for switching back the paper sheet P.

In the simplex printing, the printer unit 3 prints an image on one side of the paper sheet P. The conveyance unit 2 conveys the paper sheet P with an image printed on one side along the main conveying path 1A and discharges the same as it is onto the discharge tray ET.

In the duplex printing, the conveyance unit 2 performs a duplex-printing conveying operation after printing on one side of the paper sheet P. Specifically, the conveyance unit 2 pulls the paper sheet P with an image printed on one side (referred to as a one-side printed paper sheet P) into the second conveying path 12B via the first conveying path 11B. Further, a conveyance unit 20 reverses upper and lower sides of the one-side printed paper sheet P (switches back the one-side printed paper sheet P). In this case, the switchback roller pair 25S rotates forward until the rear end (the second end E2) of the one-side printed paper sheet P passes a junction of the first conveying path 11B and the second conveying path 12B, and then rotates backward after the rear end of the one-side printed paper sheet P has passed the junction. In this way, the front and rear ends of the one-side printed paper sheet P are reversed (the one-side printed paper sheet P is switched back). In other words, the second end E2 of the paper sheet P becomes the front end, and the first end E1 of the paper sheet P becomes the rear end. After that, the conveyance unit 2 returns the one-side printed paper sheet P to the main conveying path 1A on the upstream side of the printing area PA.

The conveyance unit 2 conveys the one-side printed paper sheet P, which is returned to the main conveying path 1A, to the printing area PA. In other words, the paper sheet P passes the printing area PA two times. At this time, the upper and lower sides of the one-side printed paper sheet P are reversed (the upper and lower sides of the paper sheet P that passes the printing area PA again are opposite to those when it passed the printing area PA the last time). Therefore, the printer unit 3 performs printing on the other side (not printed side) of the one-side printed paper sheet P. After that, the conveyance unit 2 conveys the paper sheet P after printing images on both sides along the main conveying path 1A and discharges it onto the discharge tray ET.

The printer unit 3 is disposed above the belt unit 23 so as to face the conveyor belt 231 with a space between them. The printer unit 3 prints an image on the paper sheet P on the conveyor belt 231. The printer unit 3 performs printing for each main scanning line extending in a main scanning direction (in a direction perpendicular to the sheet conveying direction).

The printer unit 3 includes four ink heads 30. The four ink heads 30 store cyan ink, magenta ink, yellow ink, and black ink, respectively. Further, each of the four ink heads 30 has a plurality of nozzles 31 for ejecting ink (see FIG. 3). Each of the nozzles 31 is equipped with a piezoelectric element (not shown). When the piezoelectric element is applied with a drive voltage, the nozzle 31 corresponding to the piezoelectric element applied with the drive voltage is driven (the nozzle 31 ejects ink).

Figure 3:
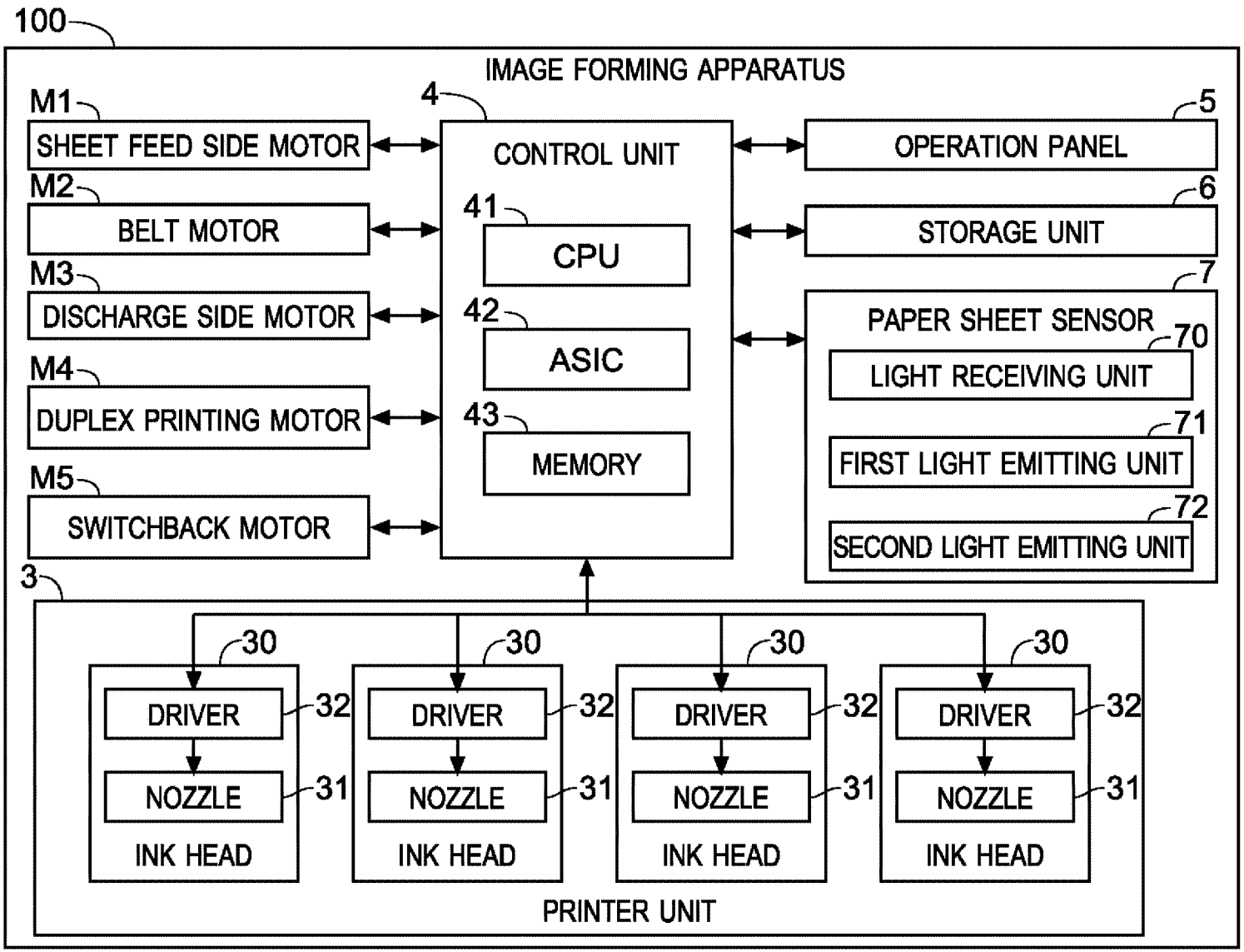
FIG. 3 is a block diagram illustrating a structure of the image forming apparatus according to one embodiment of the present disclosure.

Further, as illustrated in FIG. 3, the image forming apparatus 100 includes a control unit 4. The control unit 4 includes a CPU 41, an ASIC 42, and a memory 43. The CPU 41 works based on a control program and control data so as to perform a process for controlling each unit of the image forming apparatus 100. The ASIC 42 performs a specific process. The memory 43 stores the control program and the control data.

Further, the control unit 4 controls conveyance motors for rotating rollers of the conveyance unit 2 (controls conveyance of the paper sheet P by the conveyance unit 2). The conveyance motors include a sheet feed side motor M1, a belt motor M2, a discharge side motor M3, a duplex printing motor M4, and a switchback motor M5.

The sheet feed side motor M1 is connected to the sheet feed roller pair 21 and the sheet feed side conveyance roller pair 22. The control unit 4 controls the sheet feed side motor M1 so that the sheet feed roller pair 21 and the sheet feed side conveyance roller pair 22 rotate appropriately.

The belt motor M2 is connected to the driving roller 232 of the belt unit 23. The control unit 4 controls the belt motor M2 so that the driving roller 232 rotates appropriately. In other words, the control unit 4 controls the conveyor belt 231 of the belt unit 23 to turn appropriately.

The discharge side motor M3 is connected to the discharge side conveyance roller pair 24. The control unit 4 controls the discharge side motor M3 so that the discharge side conveyance roller pair 24 rotates appropriately.

The duplex printing motor M4 is connected to the duplex printing conveyance roller pairs 25 other than the switchback roller pair 25S. The control unit 4 controls the duplex printing motor M4 so that the duplex printing conveyance roller pair 25 rotates appropriately.

The switchback motor M5 is connected to the switchback roller pair 25S. The control unit 4 controls the switchback motor M5 so that the switchback roller pair 25S rotates appropriately. The control unit 4 switches the rotation direction of the switchback roller pair 25S between forward and backward directions.

Further, the control unit 4 controls a driver 32 of the printer unit 3 (controls printing by the printer unit 3). The driver 32 is a circuit for controlling ink ejection. The driver 32 is disposed in each ink head 30. The control unit 4 gives an operation instruction to the driver 32 of each ink head 30.

Further, the image forming apparatus 100 includes an operation panel 5. The operation panel 5 receives settings and instructions for printing from a user. For instance, the operation panel 5 includes a touch screen. The touch screen displays a screen for receiving settings and instructions for printing. The operation panel 5 is connected to the control unit 4. The control unit 4 controls a display operation of the operation panel 5 and detects an operation made on the operation panel 5.

Further, the image forming apparatus 100 includes a storage unit 6. The storage unit 6 includes a nonvolatile storage device such as a ROM (e.g. an EEPROM or the like) and an HDD. The storage unit 6 is connected to the control unit 4. The control unit 4 reads information from and writes information to the storage unit 6.

<Paper Sheet Sensor>

The image forming apparatus 100 includes a paper sheet sensor 7. The paper sheet sensor 7 is an optical sensor. The detection area DA of the paper sheet sensor 7 (see FIG. 1) is set at a position in the main conveying path 1A on the upstream side in the sheet conveying direction of the printing area PA (a printing area of the ink head 30 on a most upstream side in the sheet conveying direction), and on the downstream side in the sheet conveying direction of the junction of the main conveying path 1A and the duplex-printing conveying path 1B (the second conveying path 12B).

The paper sheet sensor 7 includes a light receiving unit 70, a first light emitting unit 71, and a second light emitting unit 72. The light receiving unit 70 includes a phototransistor, for example. The first light emitting unit 71 includes a light emitting diode, for example. The second light emitting unit 72 includes a light emitting diode, for example.

Figure 4:
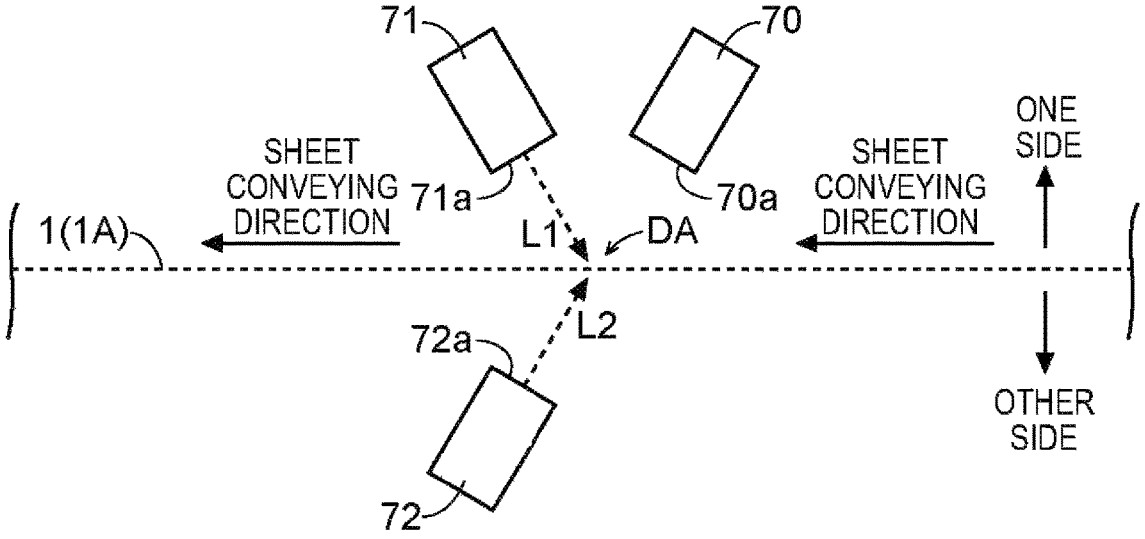
FIG. 4 is a diagram illustrating a mounting position of a paper sheet sensor in the image forming apparatus according to one embodiment of the present disclosure.

Here, with reference to FIG. 4, a positional relationship among the light receiving unit 70, the first light emitting unit 71, and the second light emitting unit 72 is described. In FIG. 4, the conveying path 1 (the main conveying path 1A) is shown by a broken line. Further in FIG. 4, light beams from the first light emitting unit 71 and the second light emitting unit 72 are schematically shown by broken line arrows. A direction indicated by the broken line arrow is a propagation direction of light. In order to distinguish light of the first light emitting unit 71 from light of the second light emitting unit 72, the broken line arrow indicating the light of the first light emitting unit 71 is denoted by L1, while the broken line arrow indicating the light of the second light emitting unit 72 is denoted by L2. The same is true in FIGS. 6 and 7 to be referred to in the following description.

The first light emitting unit 71 is disposed on one side of the conveying path 1 (on the above side of the conveying path 1). The first light emitting unit 71 emits light from the one side of the conveying path 1 to the detection area DA. The first light emitting unit 71 is disposed on the downstream side of the detection area DA in the sheet conveying direction, and is tilted so that a light emitting surface 71*a* is directed to the detection area DA.

The second light emitting unit 72 is disposed on the other side opposite to the one side of the conveying path 1 (on the below side of the conveying path 1). The second light emitting unit 72 emits light from the other side of the conveying path 1 to the detection area DA. In other words, the second light emitting unit 72 emits light to the detection area DA from a position opposite to the light emitting position of the first light emitting unit 71 with respect to the conveying path 1. The second light emitting unit 72 is disposed on the downstream side of the detection area DA in the sheet conveying direction, and is tilted so that a light emitting surface 72*a* is directed to the detection area DA.

The light receiving unit 70 is disposed on the one side of the conveying path 1. The light receiving unit 70 is disposed on the upstream side of the detection area DA in the sheet conveying direction, and is tilted so that a light receiving surface 70*a* is directed to the detection area DA. When the light receiving unit 70 does not receive light, it outputs a low level signal. When the light receiving unit 70 receives light from the first light emitting unit 71 or light from the second light emitting unit 72, its output signal is changed from low level to high level (corresponding to a "predetermined level").

Figure 6:
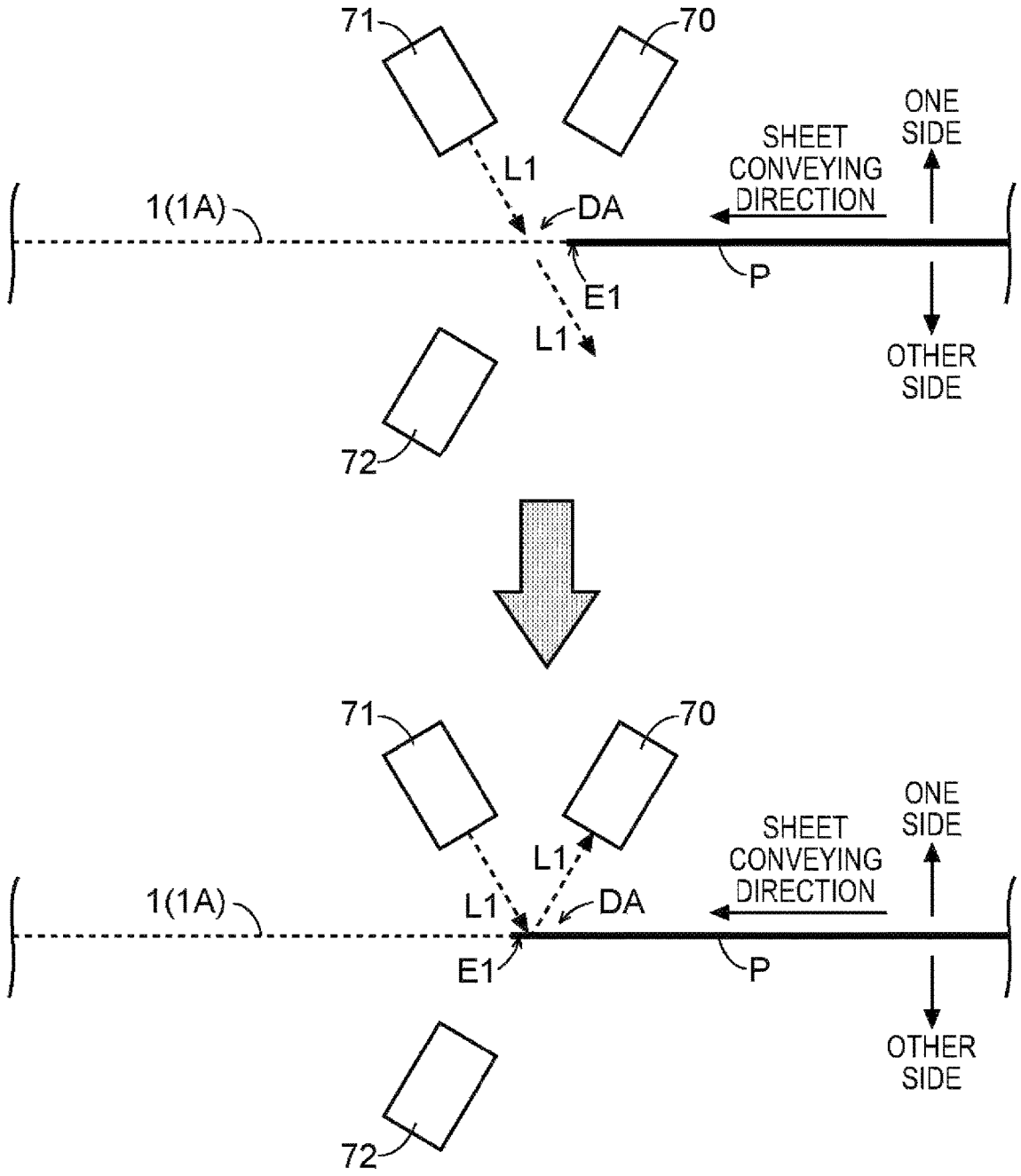
FIG. 6 is a diagram illustrating a state where a front end of the paper sheet has reached a detection area in the image forming apparatus according to one embodiment of the present disclosure.

When the first light emitting unit 71 emits light, if the paper sheet P is in the detection area DA, the light receiving unit 70 receives the light L1 reflected by the paper sheet P (see the lower part of FIG. 6). Further, when the second light emitting unit 72 emits light, if the paper sheet P is not in the detection area DA, namely if the light L2 is not reflected by the paper sheet P, the light receiving unit 70 receives the light L2 that is not reflected by the paper sheet P but is transmitted (see the lower part of FIG. 7).

The paper sheet sensor 7 is connected to the control unit 4. The control unit 4 performs a light emission control process for controlling the first light emitting unit 71 and the second light emitting unit 72. The control unit 4 switches on and off of light emission of the first light emitting unit 71 and the second light emitting unit 72. Further, the control unit 4 monitors a level of the output signal of the light receiving unit 70. The control unit 4 performs a length detection process for detecting the length in the sheet conveying direction of the paper sheet P that is being conveyed along the conveying path 1, by using the paper sheet sensor 7. Details thereof will be described later.

Figure 5:
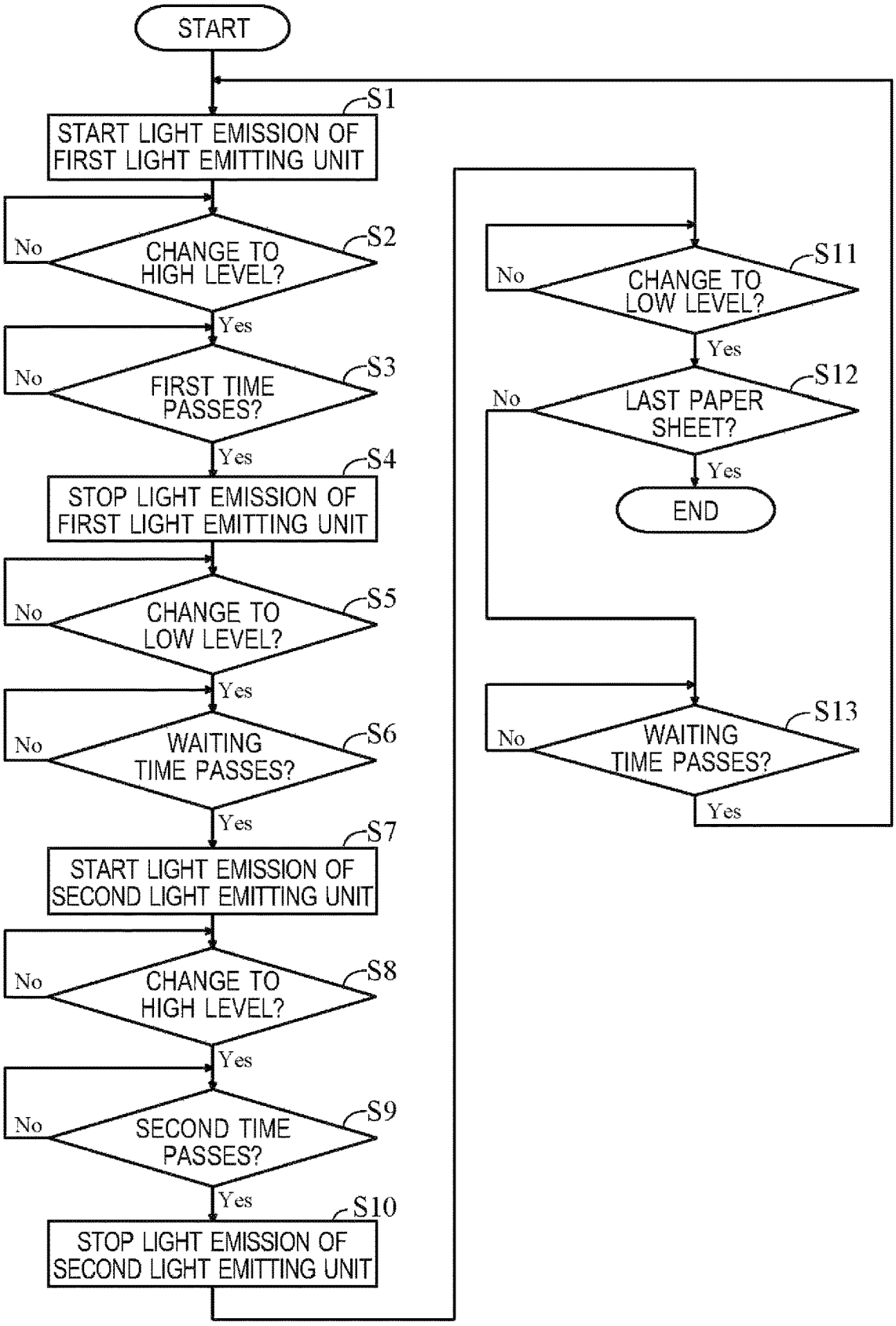
FIG. 5 is a flowchart illustrating a flow of a light emission control process performed by a control unit of the image forming apparatus according to one embodiment of the present disclosure.

Hereinafter, with reference to a flowchart shown in FIG. 5, a flow of the light emission control process performed by the control unit 4 is described. The flowchart shown in FIG. 5 starts when the conveyance unit 2 feeds the paper sheet P to the conveying path 1. At the start of the flowchart shown in FIG. 5, light emission of the first light emitting unit 71 and light emission of the second light emitting unit 72 are stopped. Therefore, at the start of the flowchart shown in FIG. 5, the output signal of the light receiving unit 70 is low level.

In Step S1, the control unit 4 starts the light emission of the first light emitting unit 71 in the state where the light emission of the second light emitting unit 72 is stopped. For instance, it may be possible to start the light emission of the first light emitting unit 71 when the fed paper sheet P reaches the registration roller pair 22R. Alternatively, it may be possible to start the light emission of the first light emitting unit 71 when the registration roller pair 22R starts conveying the paper sheet P that has reached the registration roller pair 22R. In any case, the control unit 4 starts the light emission of the first light emitting unit 71 before the front end (the first end E1) of the fed paper sheet P reaches the detection area DA.

In Step S2, the control unit 4 determines whether or not the output signal of the light receiving unit 70 has changed from low level to high level during light emission of the first light emitting unit 71. If the control unit 4 determines that the output signal of the light receiving unit 70 has changed to high level, the process flow proceeds to Step S3. If the output signal of the light receiving unit 70 has changed to high level during light emission of the first light emitting unit 71, the control unit 4 detects that the front end (the first end E1) of the paper sheet P has reached the detection area DA. On the contrary, if the control unit 4 determines that the output signal of the light receiving unit 70 has not changed to high level (is kept at low level), the process in Step S2 is repeated. The fact that the output signal of the light receiving unit 70 has not changed to high level means that the front end of the paper sheet P has not reached the detection area DA.

Here, as illustrated in FIG. 6, after the first light emitting unit 71 starts emitting light, until the front end of the paper sheet P (shown by a thick line in FIG. 6) reaches the detection area DA (see the upper part of FIG. 6), the light L1 of the first light emitting unit 71 is transmitted from one side to the other side. Therefore the light receiving unit 70 does not receive the light L1. Thus, the output signal of the light receiving unit 70 is kept at low level.

In contrast, when the front end of the paper sheet P has reached the detection area DA (see the lower part of FIG. 6), the light L1 of the first light emitting unit 71 is reflected by the paper sheet P. Therefore the light receiving unit 70 receives the light L1. Thus, the output signal of the light receiving unit 70 changes to high level.

With reference to FIG. 5 again, in Step S3, the control unit 4 determines whether or not a predetermined first time has passed after the output signal of the light receiving unit 70 changed to high level during light emission of the first light emitting unit 71. Note that the first time is set to a time shorter than the time necessary for the rear end of the paper sheet P, which has the smallest length in the sheet conveying direction (hereinafter referred to as a smallest paper sheet P), to pass the detection area DA after the front end of the smallest paper sheet P has reached the detection area DA, when the smallest paper sheet P is conveyed (hereinafter referred to as a smallest sheet passing time).

In Step S3, if the control unit 4 determines that the first time has passed, the process flow proceeds to Step S4. On the contrary, if the control unit 4 determines that the first time has not passed, the process in Step S3 is repeated. In Step S4, the control unit 4 stops light emission of the first light emitting unit 71. The control unit 4 stops light emission of the first light emitting unit 71 before the rear end (the second end E2) of the paper sheet P passes the detection area DA.

When the light emission of the first light emitting unit 71 is stopped, the light receiving unit 70 does not receive light. Therefore, after the light emission of the first light emitting unit 71 is stopped, charge stored in an internal parasitic capacitance of the phototransistor of the light receiving unit 70 is discharged via a resistor (a voltage is decreased). In this way, the output signal of the light receiving unit 70 changes from high level to low level.

In Step S5, the control unit 4 determines whether or not the output signal of the light receiving unit 70 has changed from high level to low level due to stopping of the light emission of the first light emitting unit 71. If the control unit 4 determines that the output signal of the light receiving unit 70 has changed to low level, the process flow proceeds to Step S6. On the contrary, if the control unit 4 determines that the output signal of the light receiving unit 70 has not changed to low level (is kept at high level), the process in Step S5 is repeated.

In Step S6, the control unit 4 determines whether or not a predetermined waiting time has passed after the output signal of the light receiving unit 70 changed to low level due to stopping of the light emission of the first light emitting unit 71. Note that the waiting time is set so that a total time of the first time and the waiting time is shorter than the smallest sheet passing time (e.g. a half of the smallest sheet passing time).

In Step S6, if the control unit 4 determines that the waiting time has not passed, the process in Step S6 is repeated. On the contrary, if the control unit 4 determines that the waiting time has passed, the process flow proceeds to Step S7. In Step S7, the control unit 4 starts the light emission of the second light emitting unit 72 in the state where the light emission of the first light emitting unit 71 is stopped. The control unit 4 starts the light emission of the second light emitting unit 72 before the rear end of the paper sheet P (the second end E2) passes the detection area DA.

In Step S8, the control unit 4 determines whether or not the output signal of the light receiving unit 70 has changed from low level to high level during light emission of the second light emitting unit 72. If the control unit 4 determines that the output signal of the light receiving unit 70 has changed to high level, the process flow proceeds to Step S9. When the output signal of the light receiving unit 70 has changed to high level during light emission of the second light emitting unit 72, the control unit 4 detects that the rear end (second end E2) of the paper sheet P has passed the detection area DA. On the contrary, if the control unit 4 determines that the output signal of the light receiving unit 70 has not changed to high level (is kept at low level), the process in Step S8 is repeated. The fact that the output signal of the light receiving unit 70 has not changed to high level means that the rear end of the paper sheet P has not passed the detection area DA.

Figure 7:
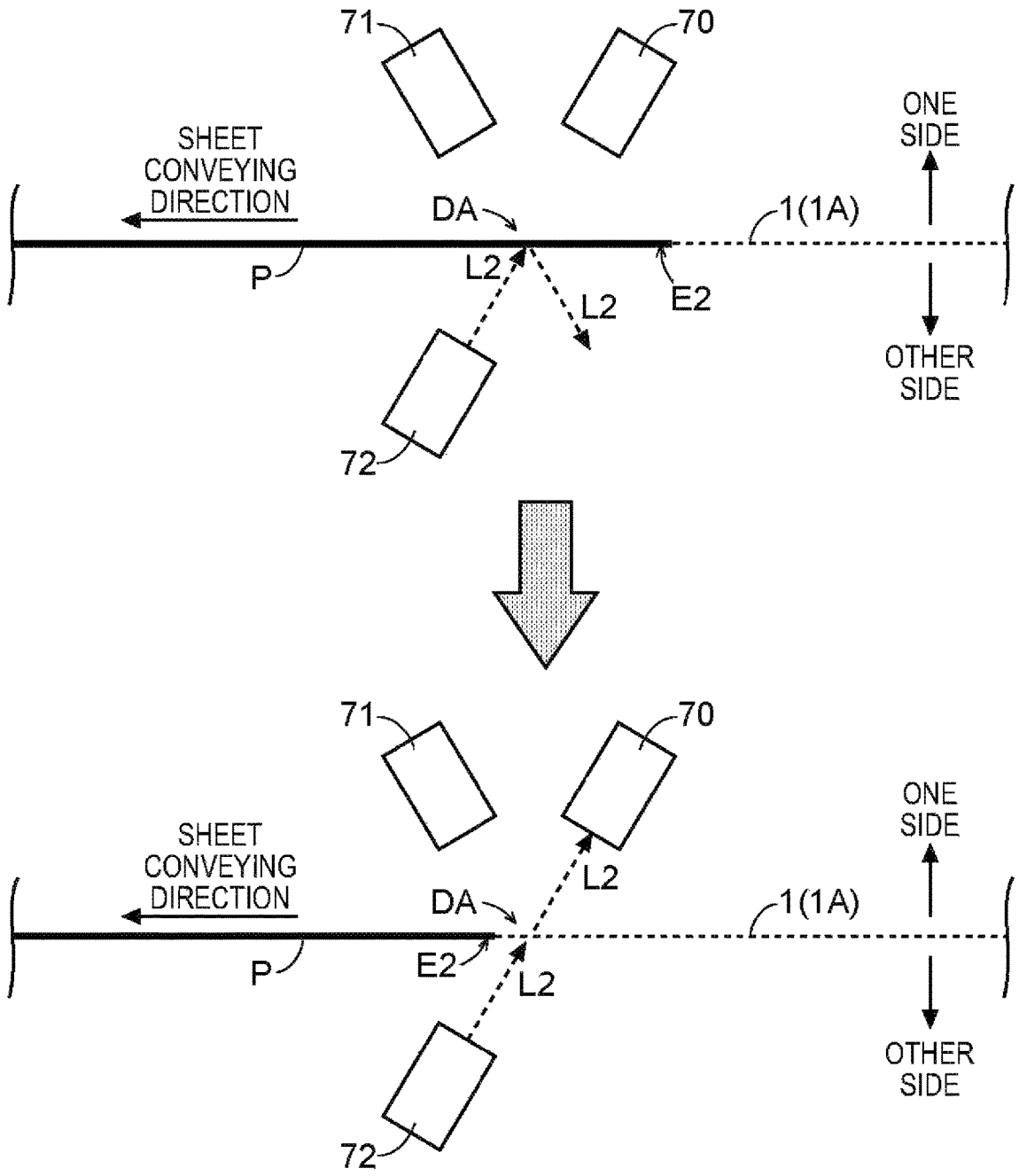
FIG. 7 is a diagram illustrating a state where a rear end of the paper sheet has passed the detection area in the image forming apparatus according to one embodiment of the present disclosure.

Here, as illustrated in FIG. 7, after the second light emitting unit 72 starts emitting light, until the rear end of the paper sheet P (shown by a thick line in FIG. 7) passes detection area DA (see the upper part of FIG. 7), the light L2 of the second light emitting unit 72 is reflected by the paper sheet P. Therefore the light receiving unit 70 does not receive the light L2. Therefore, the output signal of the light receiving unit 70 is kept at low level.

On the contrary, when the rear end of the paper sheet P has passed the detection area DA (see the lower part of FIG. 7), the light L2 of the second light emitting unit 72 is transmitted from the other side to one side. Therefore the light receiving unit 70 receives the light L2. Thus, the output signal of the light receiving unit 70 is changed to high level.

With reference to FIG. 5 again, in Step S9, the control unit 4 determines whether or not a predetermined second time has passed after the output signal of the light receiving unit 70 changes to high level during light emission of the second light emitting unit 72. Note that the second time is set to a time different from the first time. For instance, the second time is set to a time shorter than the first time. The second time may also be set to a time longer than the first time.

In Step S9, if the control unit 4 determines that the second time has passed, the process flow proceeds to Step S10. On the contrary, if the control unit 4 determines that the second time has not passed, the process in Step S9 is repeated. In Step S10, the control unit 4 stops light emission of the second light emitting unit 72.

When the light emission of the second light emitting unit 72 is stopped, the light receiving unit 70 does not receive light. Therefore the output signal of the light receiving unit 70 is changed from high level to low level.

In Step S11, the control unit 4 determines whether or not the output signal of the light receiving unit 70 has changed from high level to low level due to stopping of the light emission of the second light emitting unit 72. If the control unit 4 determines that the output signal of the light receiving unit 70 has changed to low level, the process flow proceeds to Step S12. On the contrary, if the control unit 4 determines that the output signal of the light receiving unit 70 has not changed to low level (is kept at high level), the process in Step S11 is repeated.

In Step S12, the control unit 4 determines whether or not the paper sheet P whose rear end is detected to have passed in the process of Step S8 is the last paper sheet P. If the paper sheet P to be conveyed to the printing area PA (the paper sheet P on which an image is to be printed) is not left, the control unit 4 determines that the paper sheet P whose rear end is detected to have passed in the process of Step S8 is the last paper sheet P.

In Step S12, if the control unit 4 determines that the paper sheet P whose rear end is detected to have passed in the process of Step S8 is the last paper sheet P, this flow is finished. On the contrary, in Step S12, if the control unit 4 determines that the paper sheet P whose rear end is detected to have passed in the process of Step S8 is not the last paper sheet P, the process flow proceeds to Step S13.

In Step S13, the control unit 4 determines whether or not a waiting time (e.g. the same waiting time used in the process of Step S6) has passed after the output signal of the light receiving unit 70 changed to low level due to stopping of the light emission of the second light emitting unit 72. If the control unit 4 determines that the waiting time has not passed, the process in Step S13 is repeated. On the contrary, if the control unit 4 determines that the waiting time has passed, the process flow proceeds to Step S1.

Figure 8:
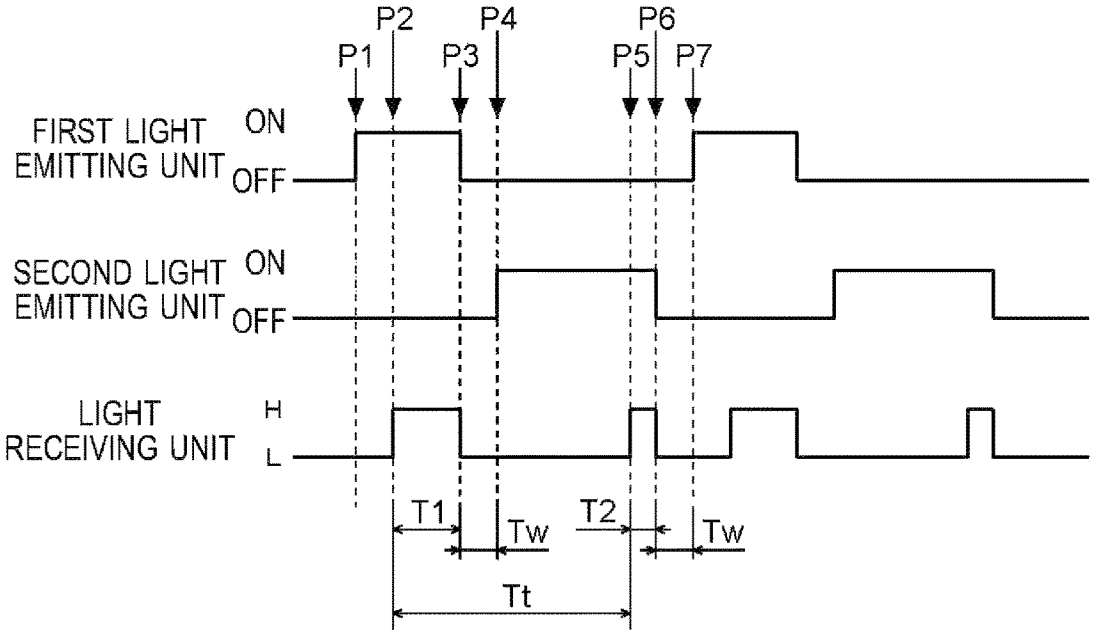
FIG. 8 is a diagram illustrating a level change of a signal output from a light receiving unit in the image forming apparatus according to one embodiment of the present disclosure.

Here, with reference to a timing chart shown in FIG. 8, a level change of the signal output from the light receiving unit 70 during conveyance of the paper sheet P is described.

First, at time point P1, the first light emitting unit 71 starts emitting light. At time point P1, the front end of the paper sheet P has not reached the detection area DA. Therefore, the output signal of the light receiving unit 70 is kept at low level.

When the front end of the paper sheet P reaches the detection area DA (at time point P2), the light receiving unit 70 receives the light of the first light emitting unit 71 reflected by the paper sheet P. Therefore, the output signal of the light receiving unit 70 is changed to high level. After that, when a first time T1 passes from time point P2 (at time point P3), the first light emitting unit 71 stops emitting light. In this way, the output signal of the light receiving unit 70 changes to low level.

When a waiting time Tw passes from the time point P3 (at time point P4), the second light emitting unit 72 starts emitting light. At time point P4, the rear end of the paper sheet P has not passed the detection area DA (the paper sheet P is in the detection area DA). Therefore, the output signal of the light receiving unit 70 is kept at low level.

When the rear end of the paper sheet P passes the detection area DA (at time point P5), the light receiving unit 70 receives the light of the second light emitting unit 72 that is not reflected by the paper sheet P but is transmitted.

Therefore the output signal of the light receiving unit 70 is changed to high level. After that, when a second time T2 passes from time point P5 (at time point P6), the second light emitting unit 72 stops emitting light. In this way, the output signal of the light receiving unit 70 is changed to low level.

After that, if the paper sheet P to be conveyed to the printing area PA is left, when the waiting time Tw has passed after the output signal of the light receiving unit 70 changes to low level (at time point P7), the first light emitting unit 71 starts emitting light. After that, until the rear end of the last paper sheet P passes the detection area DA, the first light emitting unit 71 and the second light emitting unit 72 repeat on and off of light emission.

<Length Detection Process>

The control unit 4 performs the length detection process for detecting the length in the sheet conveying direction of the paper sheet P that is being conveyed to the printing area PA. Here, a case where the length detection process is performed in the duplex printing is described. The control unit 4 performs the length detection process when the printer unit 3 prints an image on one side of the paper sheet P.

The control unit 4 starts counting time when detecting that the front end (the first end E1) of the paper sheet P has reached the detection area DA in the case where the printer unit 3 prints an image on one side of the paper sheet P (in the case where the paper sheet P is being conveyed to the printing area PA for printing on one side of the paper sheet P). After that, the control unit 4 measures time after the front end of the paper sheet P is detected to reach the detection area DA until the rear end (second end E2) of the paper sheet P is detected to pass the detection area DA, as a target time (a time for calculating the length of the paper sheet P in the sheet conveying direction). Further, the control unit 4 multiplies a paper sheet conveying speed by the target time, so as to detect the result as the length of the paper sheet P in the sheet conveying direction.

In the timing chart shown in FIG. 8, a time Tt corresponds to the target time. In other words, the control unit 4 measures time after the output signal of the light receiving unit 70 changes to high level during light emission of the first light emitting unit 71 until the output signal of the light receiving unit 70 changes to high level during light emission of the second light emitting unit 72, as the target time.

Here, there may be a case where a paper sheet conveyance distance between the printing area PA (the printing area of the ink head 30 on the most upstream side in the sheet conveying direction) and the detection area DA is longer than the length of the paper sheet P in the sheet conveying direction. In this case, the control unit 4 performs the length detection process also when the printer unit 3 prints an image on the other side of the paper sheet P (when the paper sheet P is being conveyed to the printing area PA for printing on the other side of the paper sheet P).

When the printer unit 3 prints an image on the other side of the paper sheet P, the control unit 4 performs the same length detection process as in the case where the printer unit 3 prints an image on one side of the paper sheet P. In other words, after printing on one side of the paper sheet P, the control unit 4 measures time after the front end of the one-side printed paper sheet P that is switched back reaches the detection area DA, until the rear end of the one-side printed paper sheet P passes the detection area DA, as the target time. Further, the control unit 4 multiplies the paper sheet conveying speed by the target time so as to detect the result as the length of the paper sheet P in the sheet conveying direction. Note that, when the printer unit 3 prints an image on the other side of the paper sheet (when the paper sheet P is being conveyed to the printing area PA for printing on the other side of the paper sheet P), the second end E2 of the paper sheet P is the front end (the downstream side end in the sheet conveying direction), while the first end E1 of the paper sheet P is the rear end (the upstream side end in the sheet conveying direction).

As described above, the image forming apparatus 100 of this embodiment includes: the conveyance unit 2 that conveys the paper sheet P along the conveying path 1; the printer unit 3 that prints on the paper sheet P under conveyance along the conveying path 1; the first light emitting unit 71 that emits light to the detection area DA on the upstream side in the sheet conveying direction of the printing area PA for the printer unit 3 to print in the conveying path 1; the second light emitting unit 72 that emits light to the detection area DA from a position opposite to the light emitting position of the first light emitting unit 71 with respect to the conveying path 1; the light receiving unit 70 that receives the light of the first light emitting unit 71 when the light of the first light emitting unit 71 is reflected by the paper sheet P, receives the light of the second light emitting unit 72 when the light of the second light emitting unit 72 is not reflected by the paper sheet P but is transmitted, so as to output a signal of high level (a predetermined level) when receiving the light of the first light emitting unit 71 or the light of the second light emitting unit 72; and the control unit 4 that performs the length detection process, in which the light emission of the first light emitting unit 71 starts before the front end of the paper sheet P reaches the detection area DA, the light emission of the first light emitting unit 71 stops while the light emission of the second light emitting unit 72 starts before the rear end of the paper sheet P opposite to the front end passes the detection area DA, and the length of the paper sheet P in the sheet conveying direction is detected on the basis of time after the output signal of the light receiving unit 70 becomes high level during light emission of the first light emitting unit 71, until the output signal of the light receiving unit 70 becomes high level during light emission of the second light emitting unit 72.

With the structure of this embodiment, the following effect can be obtained. In order to describe the effect obtained by the structure of this embodiment, a conventional general structure is described first.

A conventional structure uses, for example, a reflection type optical sensor equipped with one light emitting unit including a light emitting diode and one light receiving unit including a phototransistor. Further, the length of the paper sheet in the sheet conveying direction is detected on the basis of time after an output signal of the optical sensor becomes high level until it becomes low level.

The optical sensor changes its output signal level in accordance with presence or absence of the paper sheet in a predetermined area (detection area) in the conveying path along which the paper sheet is conveyed. The light emitting unit emits light to the detection area. When the front end of the paper sheet reaches the detection area, light of the light emitting unit is reflected by the paper sheet. As a result, the light receiving unit receives the light, and hence an output voltage of the light receiving unit is increased. When the output voltage of the light receiving unit is increased to a high level threshold value, the optical sensor outputs a high level signal. Further, when the rear end of the paper sheet passes the detection area, the light of the light emitting unit is not reflected by the paper sheet. As a result, the light receiving unit does not receive the light, and hence the output voltage of the light receiving unit is decreased. When the output voltage of the light receiving unit is decreased to a low level threshold value, the optical sensor outputs a low level signal.

Figure 9:
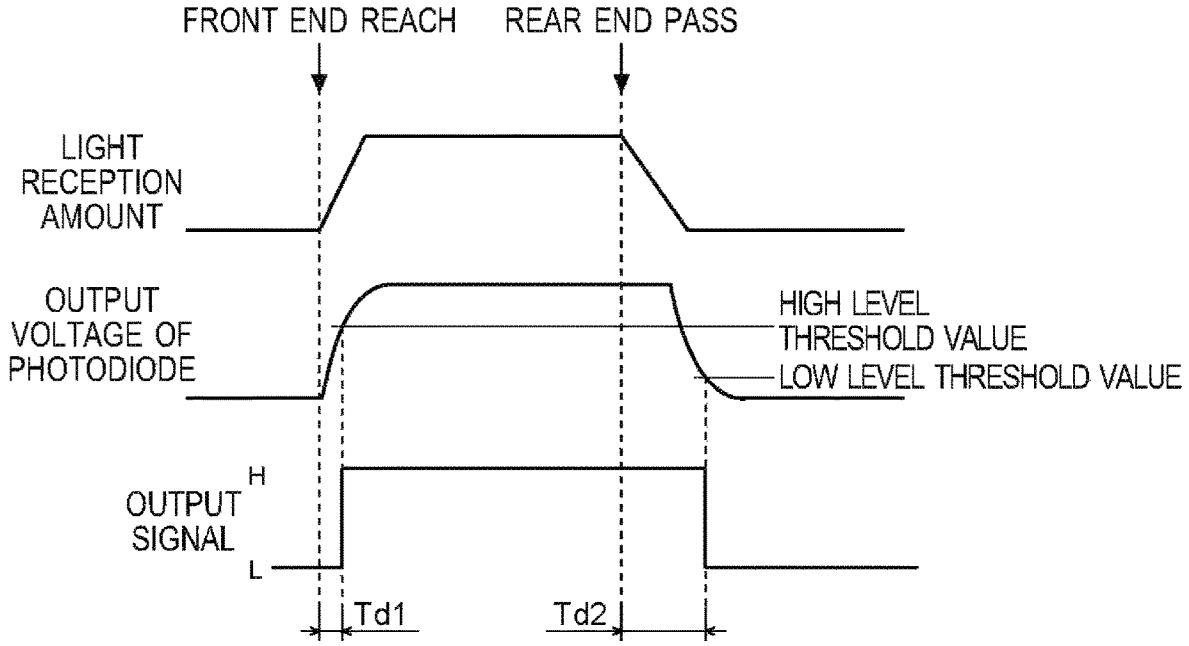
FIG. 9 is a diagram for explaining a conventional problem.

Here, as illustrated in FIG. 9, time after the front end of the paper sheet reaches the detection area until the output voltage increases to the high level threshold value is shorter than time after the rear end of the paper sheet passes the detection area until the output voltage decreases to the low level threshold value. Therefore a first delay time Td1 after the front end of the paper sheet reaches the detection area until the optical sensor outputs the high level signal is shorter than a second delay time Td2 after the rear end of the paper sheet passes the detection area until the optical sensor outputs the low level signal.

Therefore, the conventional method, in which the length of the paper sheet in the sheet conveying direction is detected based on time after the output signal of the optical sensor becomes high level until it becomes low level, the length of the paper sheet in the sheet conveying direction cannot be detected accurately. The length of the paper sheet detected by the conventional method is longer than the actual length.

In contrast, in the structure of this embodiment, the high level signal output from the light receiving unit 70 when it receives the light of the first light emitting unit 71 is detected as the signal indicating that the front end of the paper sheet P reaches. Further, the high level signal output from the light receiving unit 70 when it receives the light of the second light emitting unit 72 is detected as the signal indicating that the rear end of the paper sheet P passes. In other words, time after the front end of the paper sheet P reaches the detection area DA until the light receiving unit 70 outputs the signal (high level signal), which indicates that the front end of the paper sheet P reaches, is substantially the same as time after the rear end of the paper sheet P passes the detection area DA until the light receiving unit 70 outputs the signal (high level signal), which indicates that the rear end of the paper sheet P passes. In this way, the length of the paper sheet P in the sheet conveying direction can be detected accurately.

Further, in the structure of this embodiment, the single light receiving unit 70 is used for both the first light emitting unit 71 and the second light emitting unit 72, and hence it is not necessary to secure a large space for mounting the paper sheet sensor 7 in the image forming apparatus 100. In this way, it is possible to prevent upsizing of the image forming apparatus 100. Further, a cost increase can be suppressed because a line sensor is not used.

Further, in the structure of this embodiment, as the length of the paper sheet P in the sheet conveying direction can be detected accurately, setting and correction for printing can be performed accurately. A detailed description is added below.

In the duplex printing, the control unit 4 performs a print position setting process for setting a print position of an image printed by the printer unit 3 on the other side of the paper sheet P, on the basis of the length of the paper sheet P in the sheet conveying direction detected in the length detection process. The print position setting process is performed on the basis of the length of the paper sheet P in the sheet conveying direction detected in the length detection process when printing on one side of the paper sheet P.

Figure 10:
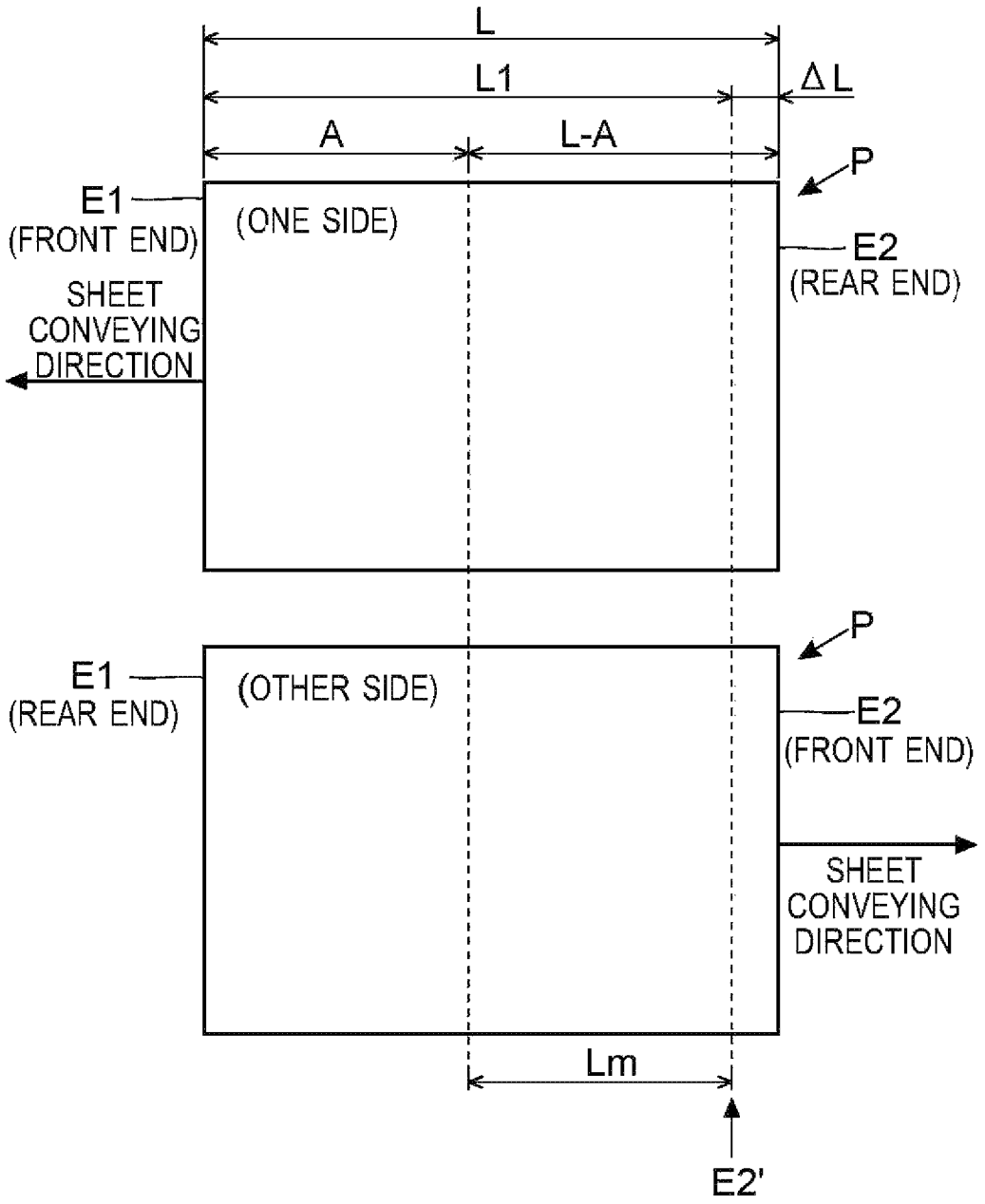
FIG. 10 is a diagram for explaining a print position setting process performed by a control unit of the image forming apparatus according to one embodiment of the present disclosure.

For instance, as illustrated in FIG. 10, in the duplex printing on the paper sheet P of a standard size (such as an A4 size), it is supposed that a detected length L of the paper sheet P in the sheet conveying direction detected in the length detection process is longer than a normal length L1 by ΔL. The normal length L1 is the length of the paper sheet P in the sheet conveying direction without an error when cutting the paper sheet P to be used for printing. For instance, if a size of the paper sheet P to be used for printing is an A4 size, the normal length L1 is 297 mm when a longitudinal direction of the paper sheet P is parallel to the sheet conveying direction, and the normal length L1 is 210 mm when a short direction of the paper sheet P is parallel to the sheet conveying direction.

Further, it is supposed that in an image to be printed on one side of the paper sheet P, there is a first image to be printed at a position spaced from the first end E1 by a distance A (at a print position of an n-th main scanning line from the first end E1 toward the second end E2). Further, it is supposed that in an image to be printed on the other side of the paper sheet P, there is a second image to be printed at a position spaced from the first end E1 by the distance A (at a print position of the n-th main scanning line from the first end E1 toward the second end E2).

Note that, if no error has occurred when cutting the paper sheet P (if the length of the paper sheet P in the sheet conveying direction is the normal length L1), a print position of an m-th main scanning line from the second end E2 toward the first end E1 is identical to the print position of the n-th main scanning line from the first end E1 toward the second end E2. In other words, if no error has occurred when cutting the paper sheet P, the print position of the m-th main scanning line from the second end E2 toward the first end E1 is the print position of the second image.

In FIG. 10, when the length of the paper sheet P in the sheet conveying direction is the normal length L1, the front end position of the paper sheet P after the switchback is denoted by E2'. Further, a distance from the position E2' to the print position of the m-th main scanning line toward the first end E1 is denoted by Lm.

When printing on one side of the paper sheet P, the control unit 4 sets the position spaced from the first end E1 that is the front end of the paper sheet P toward the second end E2 by the distance A, as the print position of the n-th main scanning line.

In contrast, when printing the other side of the paper sheet P, the control unit 4 sets the position spaced from the second end E2 that is the front end after the switched back toward the first end E1 by the distance obtained by subtracting the distance A from the detected length L, as the print position of the m-th main scanning line.

In this way, on the other side of the paper sheet P, the second image is printed at the position spaced from the first end E1 of the paper sheet P by the distance A. In other words, the second image is printed at the position spaced from the second end E2 of the paper sheet P toward the first end E1 by the distance obtained by adding the distance ΔL to the distance Lm. Further, on one side of the paper sheet P, the first image is printed at the position spaced from the first end E1 of the paper sheet P by the distance A. Therefore it is possible to prevent the print position of the second image from deviating from the print position of the first image.

Note that if the print position setting process is not performed, the second image is printed at a position spaced from the second end E2 of the paper sheet P toward the first end E1 by the distance Lm. Therefore, the print position of the second image is deviated from the print position of the first image by the distance ΔL. In contrast, in this embodiment, the print position setting process is performed as described above, and hence the deviation of the print position of the second image is suppressed.

Further, in the duplex printing, after printing on one side of the paper sheet P (before printing on the other side of the paper sheet P), the paper sheet P may be stretched in the sheet conveying direction due to loosening of paper bond caused by moisture. In other words, the length of the paper sheet P in the sheet conveying direction when printing on the other side may be longer than that when printing on one side of the paper sheet P.

Note that the present disclosure can be applied also to a case where the printing method of the image forming apparatus 100 is an electrophotographic method. In the case where the printing method is the electrophotographic method, the paper sheet P may be shrunk due to heat for fixing toner, and hence the length of the paper sheet P in the sheet conveying direction when printing on the other side may be shorter than that when printing on one side of the paper sheet P.

Therefore, the control unit 4 performs a conveying speed correction process for correcting the paper sheet conveying speed of the paper sheet P. In other words, the control unit 4 performs a process of correcting a scale of the image printed on the other side of the paper sheet P.

The control unit 4 compares the length of the paper sheet P in the sheet conveying direction detected in the length detection process when printing on one side of the paper sheet P (hereinafter referred to as a first length), with the length of the paper sheet P in the sheet conveying direction detected in the length detection process when printing on the other side of the paper sheet P (just before printing on the other side of the paper sheet P) (hereinafter referred to as a second length). If the second length is longer than the first length (if the paper sheet P is stretched in the sheet conveying direction after printing on one side of the paper sheet P), the control unit 4 performs the conveying speed correction process. Further, also if the second length is shorter than the first length (if the paper sheet P is shrunk in the sheet conveying direction after printing on one side of the paper sheet P), the control unit 4 performs the conveying speed correction process. For instance, if the value obtained by subtracting the first length from the second length is beyond a predetermined permissible range, the conveying speed correction process is performed. On the contrary, if the first length is substantially equal to the second length (if the value obtained by subtracting the first length from the second length is within the permissible range), the control unit 4 does not perform the conveying speed correction process.

For instance, when performing the conveying speed correction process, the control unit 4 calculates a ratio of the second length to the first length. Then, the control unit 4 multiplies the calculated ratio by an initial value of the paper sheet conveying speed (the paper sheet conveying speed when printing on one side of the paper sheet P) to determine a correction value, and sets a corrected paper sheet conveying speed based on the correction value. As the correction value is larger, the corrected paper sheet conveying speed is higher. In other words, as the value obtained by subtracting the first length from the second length is larger (as the stretch of paper sheet P in the sheet conveying direction is larger), the corrected paper sheet conveying speed is higher.

In this way, even if the paper sheet P is stretched in the sheet conveying direction after printing an image on (applying ink to) one side of the paper sheet P, it is possible to suppress a deviation of the second image among images to be printed on the other side of the paper sheet P from the first image printed on one side of the paper sheet P, in the case where the print positions thereof should be matched.

Note that if the distance between the printing area PA (the printing area of the ink head 30 on the most upstream side in the sheet conveying direction) and the detection area DA is shorter than the length of the paper sheet Pin the sheet conveying direction, the front end of the paper sheet P (the second end E2) reaches the printing area PA before the rear end of the paper sheet P conveyed to the printing area PA when printing on the other side of the paper sheet P (the first end E1 that is the rear end after the paper sheet P is switched back) passes the detection area DA. In other words, printing on the other side of the paper sheet P is started before the second length is detected.

Therefore, if the distance between the printing area PA and the detection area DA is shorter than the length of the paper sheet Pin the sheet conveying direction, the conveying speed correction process is not performed. Further, in this case, detection of the second length may not be performed.

Note that as a variation, control of the first light emitting unit 71 and the second light emitting unit 72 and detection of the output signal of the light receiving unit 70 may be performed by separate devices, respectively. For instance, control of the first light emitting unit 71 and the second light emitting unit 72 may be performed by the CPU 41, while detection of the output signal of the light receiving unit 70 may be performed by the ASIC 42. In this case, the CPU 41 corresponds to a "light emission control unit", and the ASIC 42 corresponds to a "light receiving control unit".

In the structure of the variation, the ASIC 42 informs the CPU 41 of a changed level of the output signal of the light receiving unit 70 every time when the level of the output signal of the light receiving unit 70 is changed, for example. The CPU 41 stops the light emission of the first light emitting unit 71 when the first time T1 (see FIG. 8) passes after the output signal of the light receiving unit 70 becomes high level (the predetermined level) during light emission of the first light emitting unit 71, and stops the light emission of the second light emitting unit 72 when the second time T2 (see FIG. 8) different from the first time T1 passes after the output signal of the light receiving unit 70 becomes high level (the predetermined level) during light emission of the second light emitting unit 72.

In the structure of the variation, the first time T1 and the second time T2 are different from each other, and hence it is possible to distinguish whether the front end of the paper sheet P has reached the detection area DA or the rear end of the paper sheet P has passed the detection area DA, on the basis of elapsed time with the output signal of the light receiving unit 70 keeping high level. Therefore, the ASIC 42 distinguishes whether the front end of the paper sheet P has reached the detection area DA or the rear end of the paper sheet P has passed the detection area DA, on the basis of elapsed time with the output signal of the light receiving unit 70 keeping high level (the predetermined level).

The embodiment disclosed in this specification is merely an example in every aspect and should not be interpreted as a limitation. The scope of the present disclosure is defined not by the above description of the embodiment but by the claims, and should be understood to include all modifications within the meaning and scope equivalent to the claims.

What is claimed is:

1. An image forming apparatus comprising:

a printer unit for printing on a paper sheet under conveyance along a conveying path;

a first light emitting unit for emitting light toward a detection area in the conveying path on an upstream side in a sheet conveying direction of a printing area for the printer unit to perform printing;

a second light emitting unit for emitting light toward the detection area from a position opposite to a light emitting position of the first light emitting unit with respect to the conveying path;

a light receiving unit for receiving light of the first light emitting unit when the light of the first light emitting unit is reflected by the paper sheet, and for receiving light of the second light emitting unit when the light of the second light emitting unit is not reflected by the paper sheet but is transmitted, so as to output a signal of a predetermined level when receiving the light of the first light emitting unit or the light of the second light emitting unit; and a control unit for performing a length detection process, in which light emission of the first light emitting unit starts before a front end of the paper sheet reaches the detection area, the light emission of the first light emitting unit stops while light emission of the second light emitting unit starts before a rear end of the paper sheet opposite to the front end passes the detection area, and a length of the paper sheet in the sheet conveying direction is detected on the basis of time after an output signal of the light receiving unit becomes the predetermined level during light emission of the first light emitting unit, until the output signal of the light receiving unit becomes the predetermined level during light emission of the second light emitting unit.

2. The image forming apparatus according to claim 1, wherein when performing duplex printing, the printer unit prints an image on one side of the paper sheet, and then prints an image on the other side opposite to the one side of the paper sheet after being switched back, and when printing on the other side, the control unit sets a print position of an image to be printed on the other side, on the basis of the length detected in the length detection process when printing on the one side.

3. The image forming apparatus according to claim 2, wherein the printer unit performs printing for each main scanning line extending in a main scanning direction perpendicular to the sheet conveying direction, out of a first end of the paper sheet and a second end opposite to the first end, the first end is the front end while the second end is the rear end when printing on the one side, and the second end is the front end while the first end is the rear end when printing on the other side after the paper sheet is switched back, the length detected in the length detection process is referred to as a length L, a distance from the first end to a print position of an n-th main scanning line toward the second end is referred to as a distance A, if no error has occurred when cutting the paper sheet, a print position of an m-th main scanning line from the second end toward the first end is identical to the print position of the n-th main scanning line, when printing on the one side, the control unit sets a position spaced from the first end as the front end of the paper sheet by the distance A toward the second end, as the print position of the n-th main scanning line, and when printing on the other side, the control unit sets a position spaced from the second end as the front end of the switched-back paper sheet toward the first end by a distance obtained by subtracting the distance A from the length L, as the print position of the m-th main scanning line.

4. The image forming apparatus according to claim 1, wherein when performing duplex printing, the printer unit prints an image on one side of the paper sheet, and then prints an image on the other side of the paper sheet opposite to the one side, the control unit performs the length detection process when printing on the one side, and also performs the length detection process when printing on the other side, and if the length detected in the length detection process when printing on the other side is longer than the length detected in the length detection process when printing on the one side, the control unit corrects a paper sheet conveying speed when printing on the other side to be higher than that when printing on the one side.

5. The image forming apparatus according to claim 1, wherein when a predetermined first time passes after the output signal of the light receiving unit becomes the predetermined level during light emission of the first light emitting unit, the control unit stops light emission of the first light emitting unit, and when a predetermined second time different from the first time passes after the output signal of the light receiving unit becomes the predetermined level during light emission of the second light emitting unit, the control unit stops light emission of the second light emitting unit.

6. The image forming apparatus according to claim 5, wherein the control unit includes a light emission control unit for controlling the first light emitting unit and the second light emitting unit, and a light receiving control unit for detecting the output signal of the light receiving unit, and the light receiving control unit distinguishes whether the front end of the paper sheet has reached the detection area or the rear end of the paper sheet has passed the detection area, on the basis of elapsed time with the output signal of the light receiving unit keeping the predetermined level.

* * * * *